US008671588B2

(12) United States Patent
Hampton

(10) Patent No.: US 8,671,588 B2
(45) Date of Patent: Mar. 18, 2014

(54) SHOE COVER

(75) Inventor: Jeffery Todd Hampton, Indianapolis, IN (US)

(73) Assignee: Freakwear, LLC, Indianapolis, IN (US)

( * ) Notice: Subject to any disclaimer, the term of this patent is extended or adjusted under 35 U.S.C. 154(b) by 937 days.

(21) Appl. No.: 12/398,795

(22) Filed: Mar. 5, 2009

(65) Prior Publication Data

US 2010/0223818 A1 Sep. 9, 2010

(51) Int. Cl.

| | |
|---|---|
| ***A43B 3/16*** | (2006.01) |
| ***A43B 13/22*** | (2006.01) |
| ***A43B 5/00*** | (2006.01) |
| ***A43B 3/18*** | (2006.01) |
| *A43B 13/14* | (2006.01) |
| *A43B 3/26* | (2006.01) |

(52) U.S. Cl.

CPC ... *A43B 3/16* (2013.01); *A43B 3/18* (2013.01); *A43B 13/141* (2013.01); *A43B 3/26* (2013.01)

USPC ..... 36/7.1 R; 36/7.3

(58) Field of Classification Search

CPC ..... A43B 3/16; A43B 3/18; A43B 13/141; A43B 13/18

USPC ..... 36/7.1 R, 7.2–7.8, 4

See application file for complete search history.

(56) References Cited

U.S. PATENT DOCUMENTS

| | | | | | |
|---|---|---|---|---|---|
| 1,994,154 | A | * | 3/1935 | Tousley | 36/4 |
| 2,171,654 | A | | 9/1939 | Hinchliff et al. | |
| 2,223,339 | A | * | 12/1940 | De Liso | 36/45 |
| 2,617,208 | A | * | 11/1952 | Davis et al. | 36/7.3 |
| 2,986,823 | A | * | 6/1961 | Kos | 36/7.1 R |
| 3,026,635 | A | * | 3/1962 | Slade | 36/7.3 |
| 3,313,047 | A | * | 4/1967 | Svien | 36/7.3 |
| 4,281,466 | A | | 8/1981 | Malone | |
| 4,944,099 | A | * | 7/1990 | Davis | 36/97 |
| 5,056,240 | A | | 10/1991 | Sherrill | |
| 5,311,676 | A | | 5/1994 | Hughes et al. | |
| 5,315,767 | A | | 5/1994 | Bradbury | |
| 5,425,186 | A | * | 6/1995 | Hoyt | 36/97 |
| 5,913,592 | A | * | 6/1999 | Moore | 36/8.1 |
| D416,378 | S | * | 11/1999 | McNaught | D2/952 |
| D450,180 | S | | 11/2001 | Matis et al. | |
| 6,584,704 | B2 | | 7/2003 | March | |
| 6,948,261 | B1 | | 9/2005 | Grasso | |
| D607,634 | S | * | 1/2010 | Andersen et al. | D2/948 |
| 8,453,355 | B2 | * | 6/2013 | Kay | 36/135 |
| 2001/0005945 | A1 | * | 7/2001 | Mitchell | 36/14 |
| 2004/0068890 | A1 | | 4/2004 | Palahnuk | |
| 2008/0184592 | A1 | * | 8/2008 | Brie et al. | 36/7.1 R |
| 2008/0301974 | A1 | * | 12/2008 | Bowen et al. | 36/7.6 |

* cited by examiner

*Primary Examiner* — Jila M Mohandesi

(74) *Attorney, Agent, or Firm* — Faegre Baker Daniels LLP

(57) ABSTRACT

A shoe cover having a covering sized to receive a shoe and a sole coupled to the covering. In one example embodiment, the covering is made of an elastic material and the sole includes a serrated edge for expanding a perimeter portion of the sole.

17 Claims, 11 Drawing Sheets

SHOE COVER

BACKGROUND AND SUMMARY OF THE INVENTION

The present invention relates generally to shoe covers.

BRIEF DESCRIPTION OF THE DRAWINGS

The detailed description of the drawings particularly refers to the accompanying figures in which.

DETAILED DESCRIPTION OF ILLUSTRATIVE EMBODIMENTS

The embodiments disclosed below are not intended to be exhaustive or to limit the invention to the precise forms disclosed in the following detailed description. Rather, the embodiments are chosen and described so that others skilled in the art may utilize their teachings.

Figure 1A:
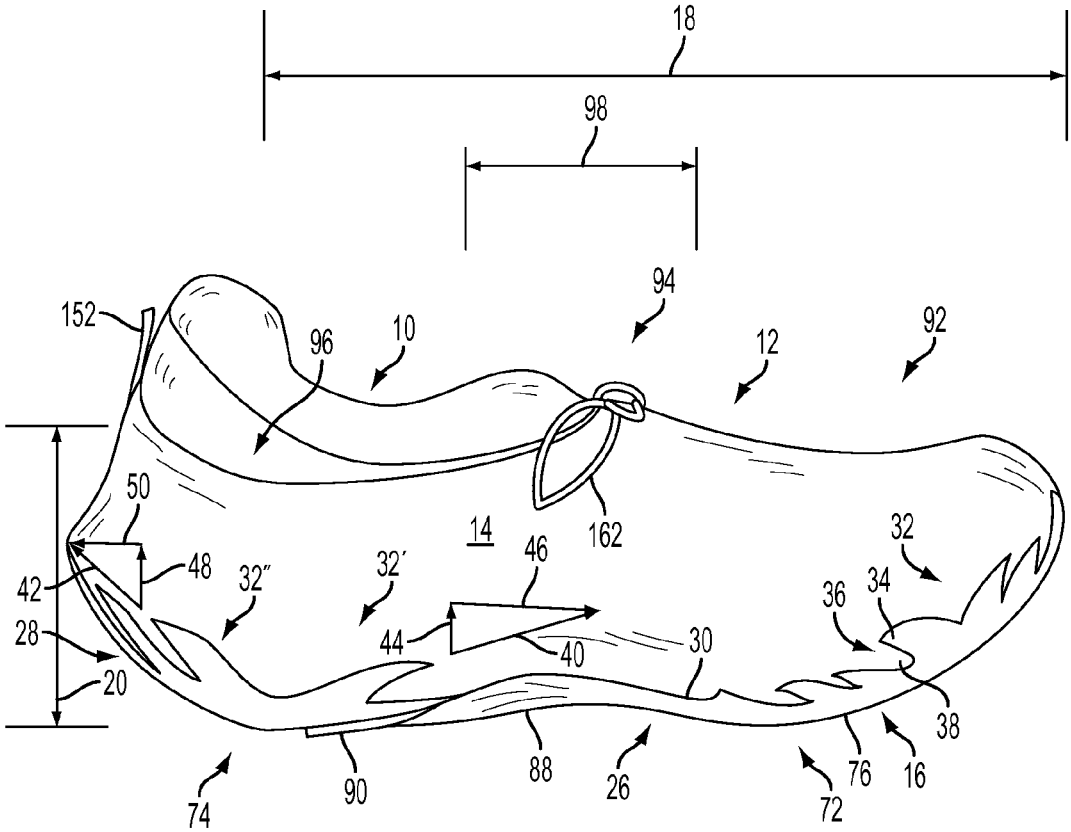
FIG. 1A is a side elevation view of a shoe covered by a shoe cover showing the shoe cover having a form-fitting covering and a sole having a plurality of finger.

As shown in FIG. 1A, shoe 10 is shown covered by shoe cover 12. Shoe cover 12 includes form-fitting covering 14 and sole 16. Shoe cover 12 is adapted to receive different sizes and styles of shoes 10. Shoes 10 may be different styles, such as running shoes, low or high top basketball shoes, cross-training shoes, dress shoes, etc. Shoes 10 may also be different sizes that provide different lengths and widths within a particular brand and model of shoe 10.

Covering 14 is preferably made of a form-fitting or elastic fabric. According to the preferred embodiment, covering 14 is made of a fabric including 90% nylon or polyester and 10% spandex or elastane. Spandex is often sold under the trademark Lycra®. According to alternative embodiments of the present disclosure, covering may be made of other highly elastic materials.

Figure 1B:
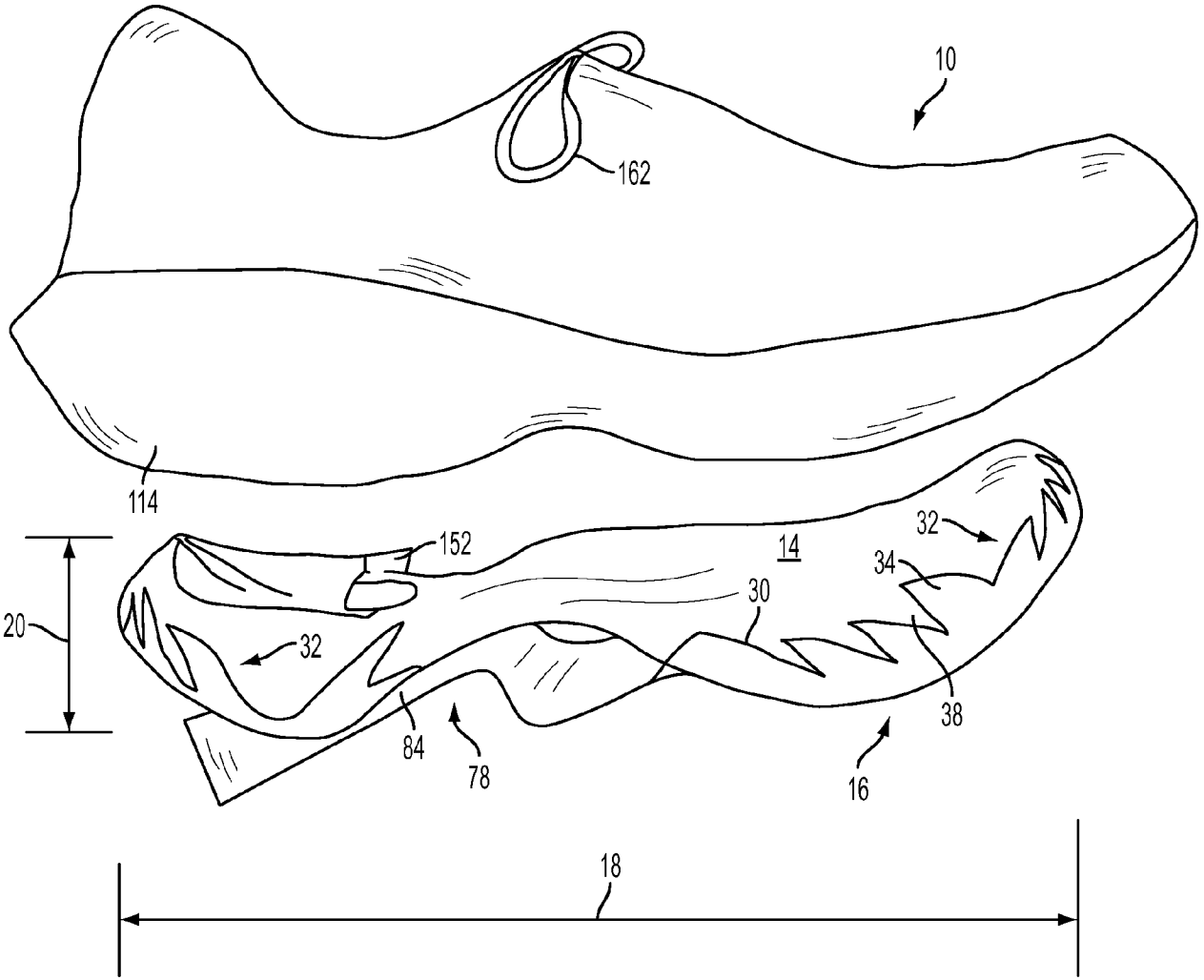
FIG. 1B is a side elevation view of the shoe and shoe cover of FIG. 1A showing the shoe cover before placement over the shoe.

Shoe cover 12 is shown before placement over shoe 10 in FIG. 1B and in an unstretched state in which its interior volume is smaller than any shoe 10 it is designated to cover. For example, if shoe cover 12 is designated to fit shoes 10 from male size 8 to 12, the interior volume of covering 14 would be smaller than the exterior volume of a male size 8 shoe 10. Similarly, unstretched length 18, unstretched height 20, and/or unstretched width 22 (see FIG. 3) of covering 14 is preferably less than the length, height, and/or width of any shoe 10 it is designated to cover. Using the example above, length 18, height 20, and/or width 22 of covering 14 would be less than the length, height, and width of a male size 8 shoe 10. By making covering 14 smaller than shoe 10 it is intended to receive, covering 14 will stretch over shoe 10 and reduce or avoid wrinkles to provide a uniform appearance. Graphics placed on covering 14 then have a more uniform appearance.

Sole 16 is adhered or otherwise coupled to covering 14 to provide durability and traction to shoe cover 12. Sole 16 is preferably made of a uniform sheets of rubber-like material, such as a fabric having substrate made of a woven polyester weighing 3 oz./yd. that is coated with PVC resin at 33 oz./yd. According to alternative embodiments of the present disclosure, sole may be made of other materials.

Figure 6:
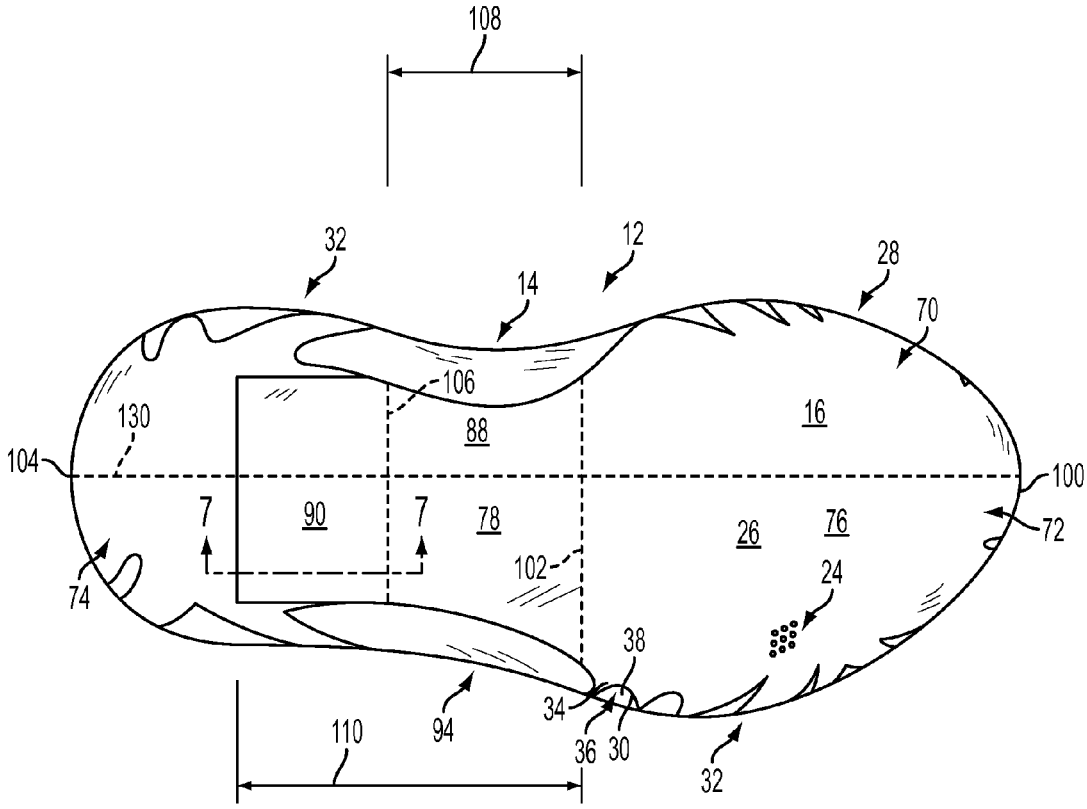
FIG. 6 is a bottom view of the shoe cover of FIG. 1A showing the plurality of fingers extending from under the shoe to the front, rear, and sides of the shoe.

As shown in FIG. 6, sole 16 may include a raised bumps 24 that extend from the sheet to provide additional traction. Only a few bumps 24 are shown in FIG. 6. Bumps 24 preferably cover the entire exposed surface of sole 16 and may form a pattern or may be random.

As shown in FIGS. 1A-6, sole 16 includes bottom portion 26 and perimeter 28. Sole 16 is much stiffer than covering 14. Because sole 16 is much stiffer, covering 14 provides substantially all of the expansion of cover 12 during receipt of shoe 10. Such differences in stiffness between a sole and a covering can result in bunching, puckering, wrinkles, or other contours in the covering that may be undesirable to the appearance of a shoe cover.

The reduce or eliminate bunching, puckering, wrinkles, and other undesirable contours resulting from the difference in stiffness as covering 14 expands, perimeter portion 28 of sole 16 is provided with means for expanding perimeter portion 28. As shown in FIGS. 1A-6, perimeter portion 26 of sole 16 includes serrated edge 30 that defines a plurality of serrations/fingers 32. Fingers 32 cooperate to define a plurality of peaks 34 and valleys 36 therebetween that have portions 38 of covering 14 positioned within the valleys 36 between peaks 34. As covering 14 expands during insertion of shoe 10, fingers 32 may spread apart and portions 38 of covering 14 may stretch. Depending on the outer contour of shoe 10, different fingers 32 will spread more than other fingers 32.

As shoe 10 is inserted into covering 14, tips of peaks 34 spread apart as necessary as covering 14 expands and portions 38 of covering 14 positioned within valleys 36 expand. Fingers 32 are adhered or otherwise coupled to covering 14. During the expansion of covering 14, the portions of covering 14 directly adhered to fingers 32 may stretch at a greater rate than fingers 32 and remain adhered to fingers 32.

Figure 2:
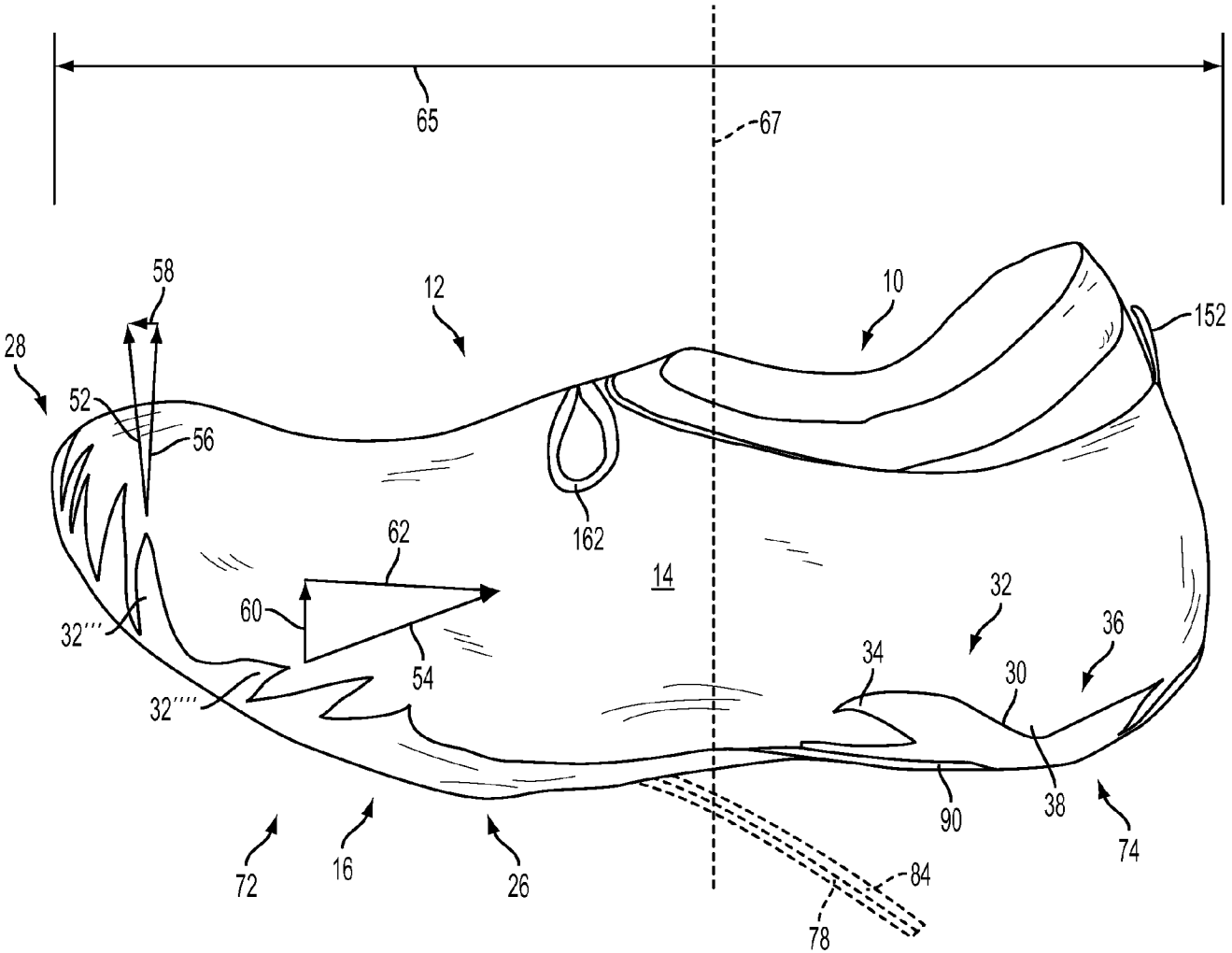
FIG. 2 is a side elevation view of the shoe and shoe cover of FIG. 1A from the opposite vantage point showing a flap of the shoe cover adhered to a heel of the shoe cover in solid lines and the flap spaced apart from the heel of the shoe cover before being adhered to the heel.

As shown in FIGS. 1A-6, fingers 32 have different shapes, lengths, and orientations. For example and as shown in FIG. 1A, finger 32' extends in direction 40 and is thinner than and finger 32" that extends in direction 42. Direction 40 has a vertical component 44 and a forward component 46. Direction 42 has a vertical component 48 and a rearward component 50. Similarly as shown in FIG. 2, finger 32''' extends in a direction 52 and is longer than finger 32'''' that extends in direction 54. Direction 52 has a vertical component 56 and a forward component 58. Direction 54 has a vertical component 60 and a rearward component 62. Cover 12 has stretched length 65 and midpoint 67 along length 65. Some of fingers 32, such as fingers 32', 32'''', at least partially extend toward midpoint 67 and other fingers 32, such as fingers 32", 32''', at least partially extend away from midpoint 67. Portions of some fingers 32 face horizontally outward and portions of some face downward, particularly the portions positioned adjacent to bottom portion 26 of sole 16.

Figure 12:
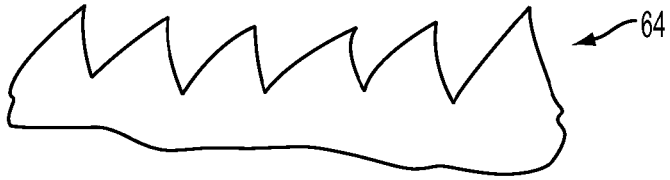
FIG. 12 is a side elevation view of alternative embodiment fingers in the shape of shark teeth.
Figure 13:
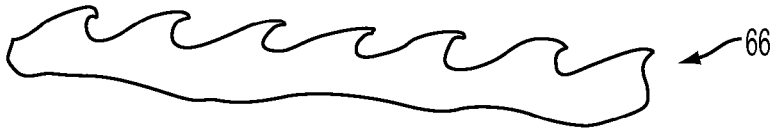
FIG. 13 is a side elevation view of other alternative embodiment fingers in the shape of cresting waves.
Figure 14:
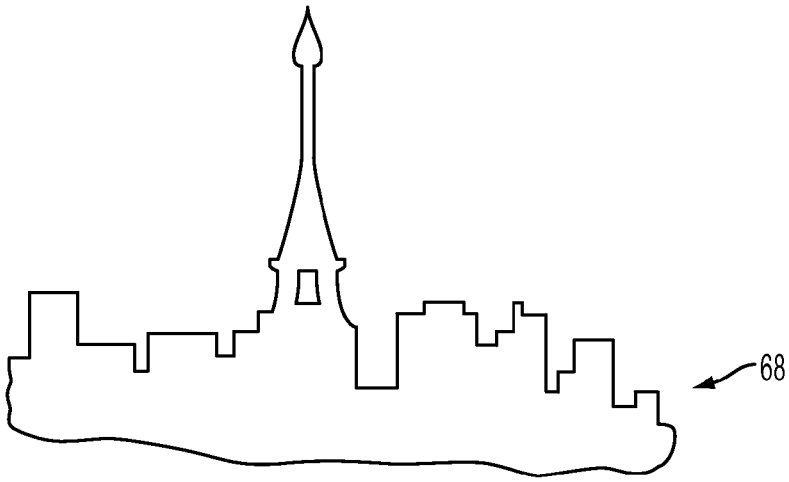
FIG. 14 is a side elevation view of other alternative embodiment fingers in the shape of the skyline of Paris.
Figure 15:
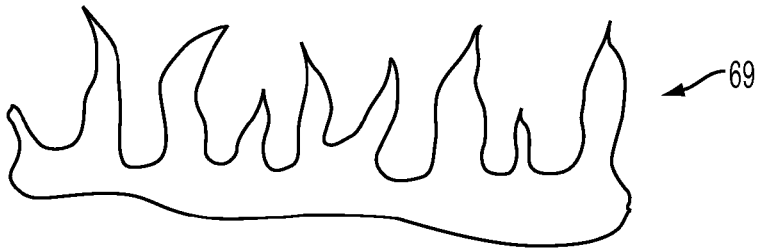
FIG. 15 is a side elevation view of other alternative embodiment fingers in the shape of flames.

As shown in FIGS. 12-15, alternative embodiment fingers may also be provided as part of perimeter portion 28 of sole 16. As shown in FIG. 12, alternative embodiment fingers 64 in the shape of shark teeth are provided. As shown in FIG. 13, fingers 66 in the shape of cresting waves are provided. As shown in FIG. 14, fingers 68 in the shape of buildings or other structures are provided in the shape of the skyline of Paris. In FIG. 15, fingers 69 in the shape of flames are provided. Other finger shapes may also be provided.

Figure 11:
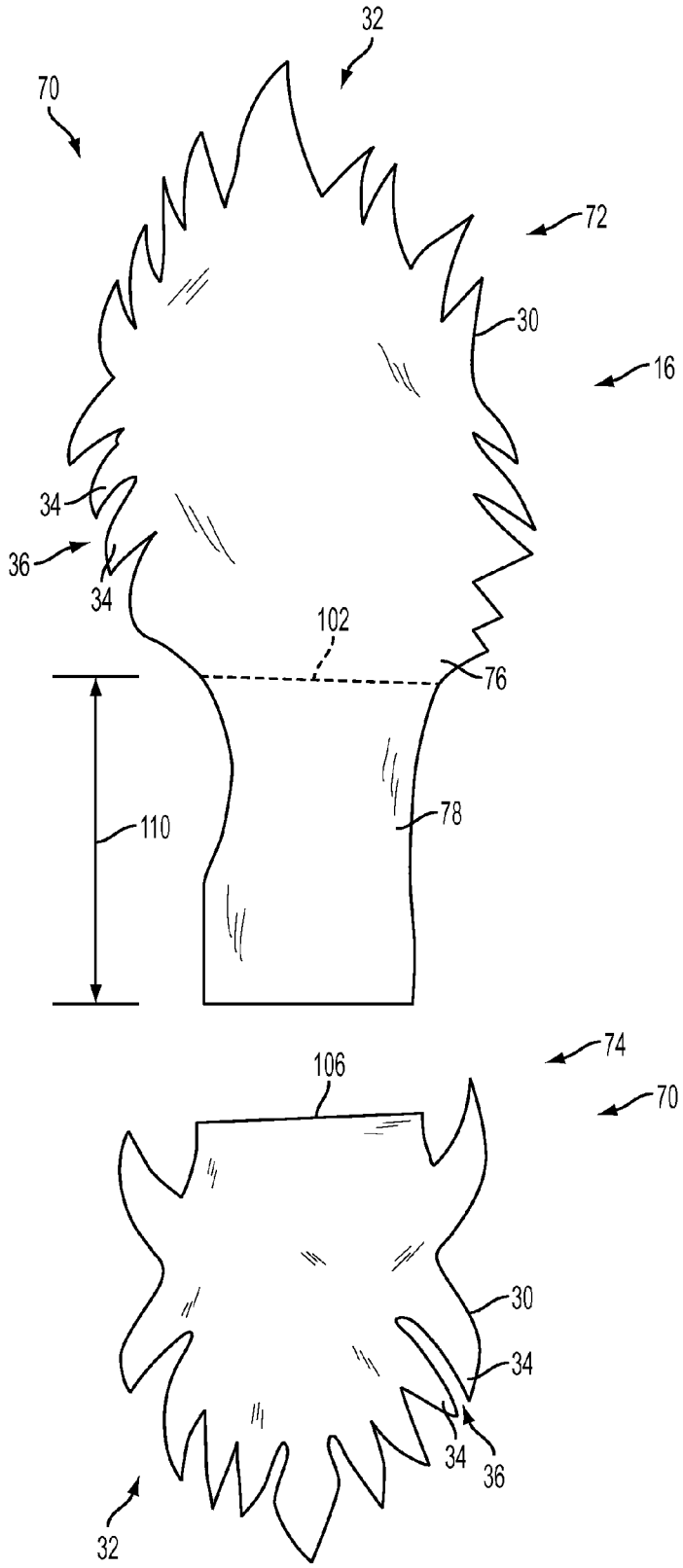
FIG. 11 is a top plan view of an outsole of the sole before being coupled to the covering.

Sole 16 is also configured to adjust in length to accommodate shoes 10 of different lengths. As shown in FIG. 11, sole 16 includes outsole 70 including forward blank 72 and rear blank 74. As shown in FIGS. 1A, 1B, 2, 4, and 6, rear blank 74 is adhered or otherwise coupled to covering 14 and defines heel 74 of sole 16. As shown in FIGS. 1A-3 and 6, forward blank 72 is adhered or otherwise coupled to covering 14 and defines front pad 76 and mid section 78 of sole 16 that is integral with front pad 76. During manufacture of cover 12, as described in greater detail below, heel 74 and front pad 76 are adhered to covering 14, but mid section 78 is not adhered directly to covering 14 during manufacture. Because mid section 78 is not adhered, it behaves as a flap 78 as shown in phantom in FIG. 2. Because flap 78 is not adhered to covering 14, the distance between front pad 76 and heel 74 can be adjusted to correspond to shoe 10 received by covering 14.

After shoe 10 is positioned in covering 14, flap 78 is adhered to heel 74. Before initial assembly of cover 12, forward and rear blanks 72, 74 include water proof, rubber-like, sheet layer 80 (shown in FIG. 7), first adhesive layer 82, and removable backing 84 (shown in FIG. 2 in phantom). Portions of backing 84 that cover front pad 76 and rear blank/heel 74 are removed so that adhesive layer 82 adhere front pad 76 and heel 74 to covering 14. The portion of backing 84 that cover flap 78 is left so that upper side 86 of adhesive layer 82 is not exposed to adhere to covering 14. After shoe 10 is positioned in covering 14, backing 84 (show in phantom in FIG. 2) is removed from flap 78 so that mid sole portion 88 of flap 78 is adhered directly to covering 14 and overlapping portion 90 is adhered directly to heel 74. As a result, overlapping portion 90 of flap 78 overlaps with heel 74 so that front pad 76, mid sole portion 88, overlapping portion 90, and heel 74 cooperate to define a continuous layer of rubber-like material that provides traction and durability to the underside of cover 12. If necessary, flap 78 may be trimmed to length to reduce or eliminate the amount of flap 78 that extends over heel 74. According to an alternative embodiment, forward and rear blanks 72, 74 are provided in a single blank without the ability to adjust the length of the sole of the shoe cover.

During insertion of shoe 10, portion of covering 14 expand to accommodate shoe 10. For example and as shown in FIG. 1A, covering 14 includes toe portion 92 generally positioned over front pad 76, mid section 94 generally positioned over mid sole portion 88 of sole 16, and heel portion 96 generally positioned above heel 74 of sole 16 expand in volume during insertion of shoe 10. Before insertion, mid section 94 of covering 14 has a unstretched length (not shown). After insertion, mid section 94 has stretched length 98 that is greater than the unstretched length and dependent upon the length of shoe 10.

As shown in FIG. 6, Front pad 76 extends from forward-most portion 100 to rear-most portion 102 where it is integrally coupled to mid sole portion 88. Heel 74 extends from rear-most portion 104 to forward-most portion 106. Distance 108 between front pad 76 and heel 74 depends on the length of shoe 10. Similarly, the length of overlapping portion 90 and mid sole portion 88 depend on the length of shoe 10 because the amount of mid section 78 that overlaps and defines overlapping portion 90 depends on the length of shoe 10. During adhesion of flap/mid section 78 to covering 14 and heel 74, flap 78 of sole 16 is not stretched like mid section 94 of covering 14. Thus, during insertion of shoe 10, unstretched length 110 of mid section 78 does not change as the length of mid section 94 of covering 14 increases to length 98 shown in FIG. 1A.

Figure 7:
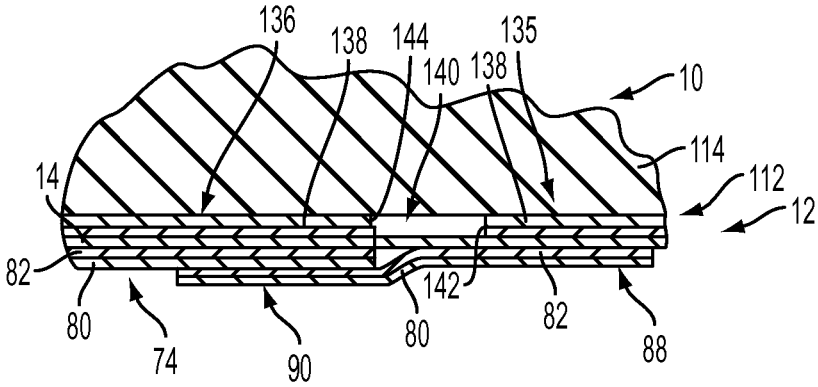
FIG. 7 is a cross-sectional view of a portion of the shoe and shoe cover of FIG. 1A taken along line 7-7 of FIG. 6 showing the flap of the sole overlapping with a heel of the sole.

In addition to outsole 70, sole 16 includes insole 112 shown in FIG. 7. Insole 112 is preferably made of the same material as outsole 70. However, rather than bumps 24 facing downward, they face upward to provide traction with sole 114 of shoe 10 to provide traction between shoe 10 and shoe cover 12. In alternative embodiments, insole 112 is not provided in the shoe cover.

Figure 9:
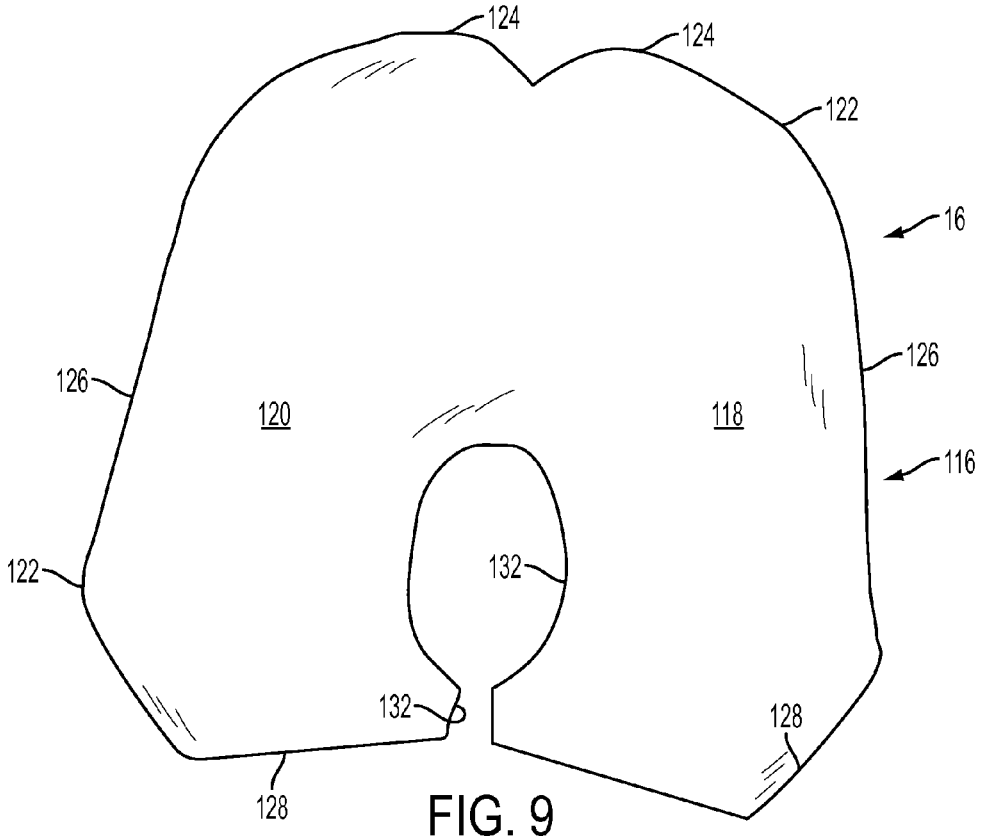
FIG. 9 is a top plan view of the form-fitting covering before it is coupled to the sole.

During assembly, covering 14, outsole 70, and insole 112 are adhered or otherwise coupled together. As shown in FIG. 9, covering blank 116 is cut, stamped, or otherwise formed from a sheet of stretchable fabric. Blank 116 includes mirror-image right and left halves 118, 120 having edges 122 with toe portions 124, mid sole portions 126, and heel portions 128. During manufacture, right and left halves 118, 120 are sewn together along toe, mid sole, and heel portions 124, 126, 128 to define seam 130. Preferably cuff portions 132 are not sewn to each other, but a lip may be provided by overlapping cuff portions 132 on themselves and sewing or otherwise coupling the cuff portions to define a cuff.

Figure 10:
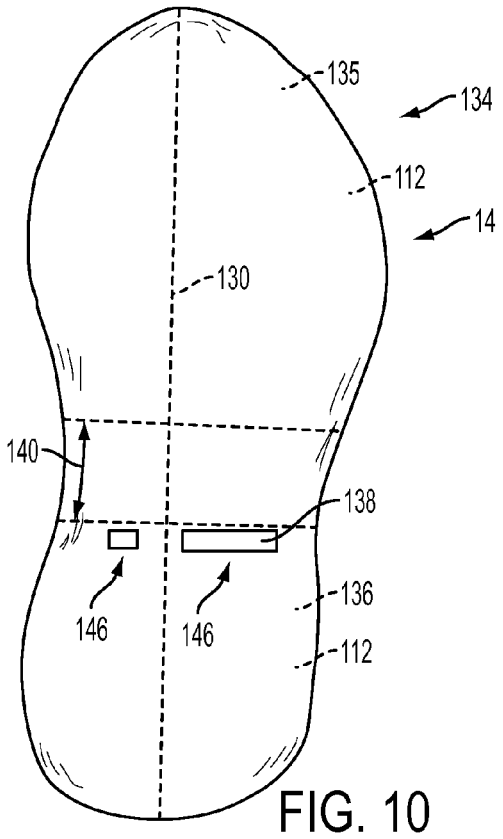
FIG. 10 is a bottom view of the covering of FIG. 9 wrapped around a shoe mold during assembly and before an outsole of the sole of the shoe is coupled to the covering.

After seam 130 is sewn, covering 14 is placed over shoe mold 134 as shown in FIG. 10, which is preferably smaller than any shoe 10 over which cover 12 is intended to fit. Next, insole 112 is adhered to covering 14.

Insole 112 includes front pad 135 that is substantially identical to front pad 76 of outsole 70 and heel 136 that is substantially identical to heel 74 of outsole 50. Unlike outsole 70, there is no flap/mid section provided on insole 112 according to the preferred embodiment. On alternative embodiments, all or portions of a flap/mid section, similar to flap 78 of outsole 70, may be provided on insole 112.

Insole 112 is adhered to covering 14 with second adhesive layer 138 so that gap 140 is provided between rear-most portion 142 of front pad 135 and forward-most portion 144 of heel 136. Gap 140 allows mid section 94 of covering 14 to stretch during insertion of shoe 10.

After insole 112 is adhered, covering 14 is turned inside out (as shown in FIG. 10) and outsole 50 is adhered to covering 14 so that covering 14 is sandwiched between insole 112 and outsole 50 as shown in FIG. 7. Preferably, fingers 32 of outsole 50 are aligned with corresponding fingers 32 of insole 112. In one embodiment, heel 136 of insole 112 is slightly longer than heel 74 of outsole 50 and the additional length of heel 136 is positioned forward of the rear-most portion of heel 74 of outsole 50 during assembly. Windows 146 are provided in covering 14 in the area where heel 136 of insole 112 extends forward of heel 74 of outsole 50. Because covering 14 does not cover portions of second adhesive layer 138 positioned under windows 146, first adhesive layer 82 of associated with flap 78 makes direct contact with second adhesive layer 138.

According to an alternative method of assembly cover 12, sewing is not used to hold edges 122 of covering 14 together. In this method, covering 14 is wrapped around mold 134 so that edges 122 are together. Edges 122 are held together until insole 112 is adhered to covering 14, which then holds edges 122 together.

Figure 3:
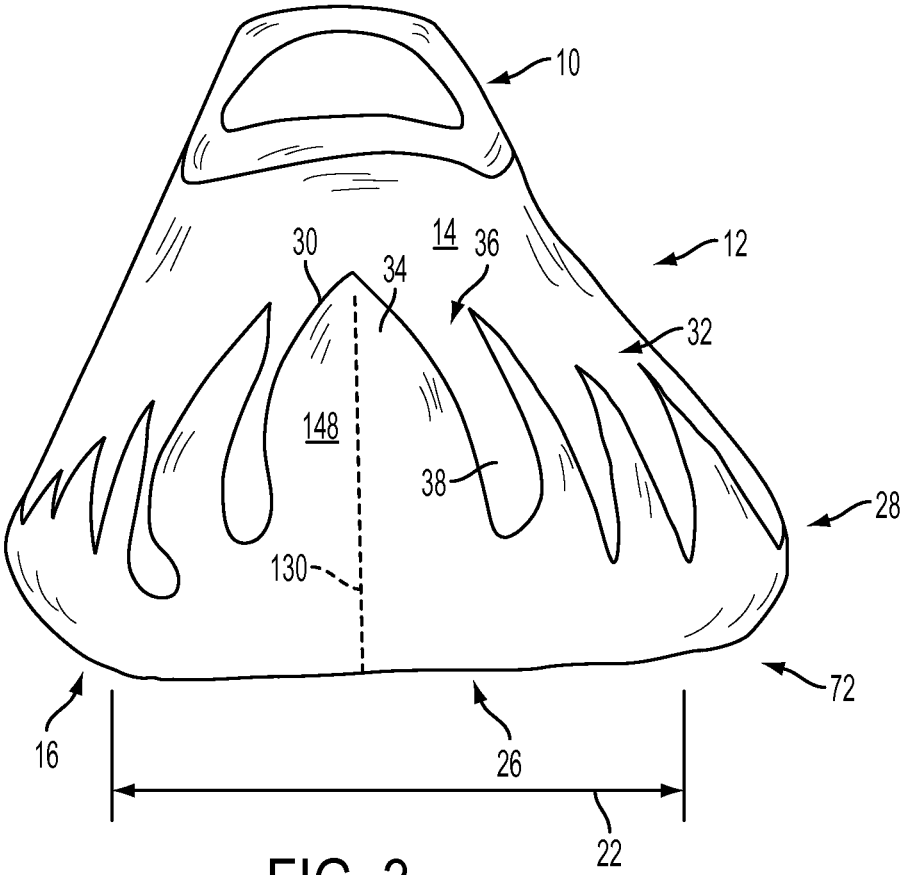
FIG. 3 is a front elevation view of the shoe and shoe cover of FIG. 1A showing the sole having a plurality of fingers at the front of the shoe cover and a seam shown in phantom positioned behind a center finger.
Figure 4:
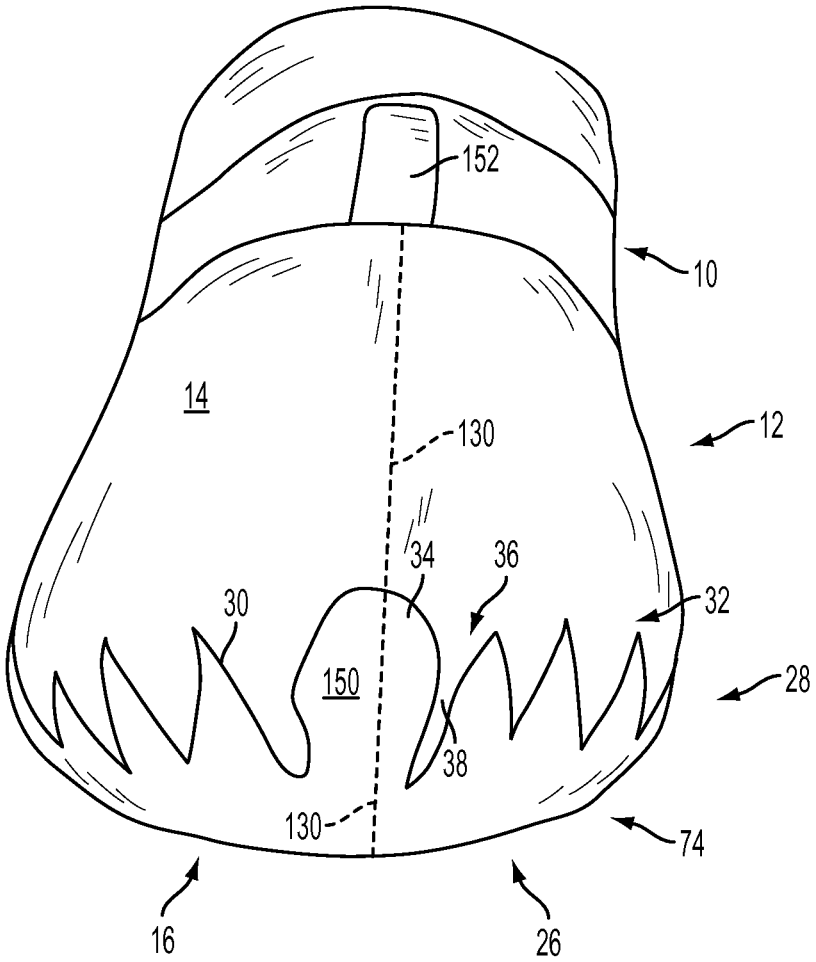
FIG. 4 is a rear elevation view of the shoe and shoe cover of FIG. 1A showing the sole having a plurality of fingers at the rear of the shoe cover and a seam shown partially in phantom positioned behind a center finger and partially in solid positioned above the center finger.
Figure 5:
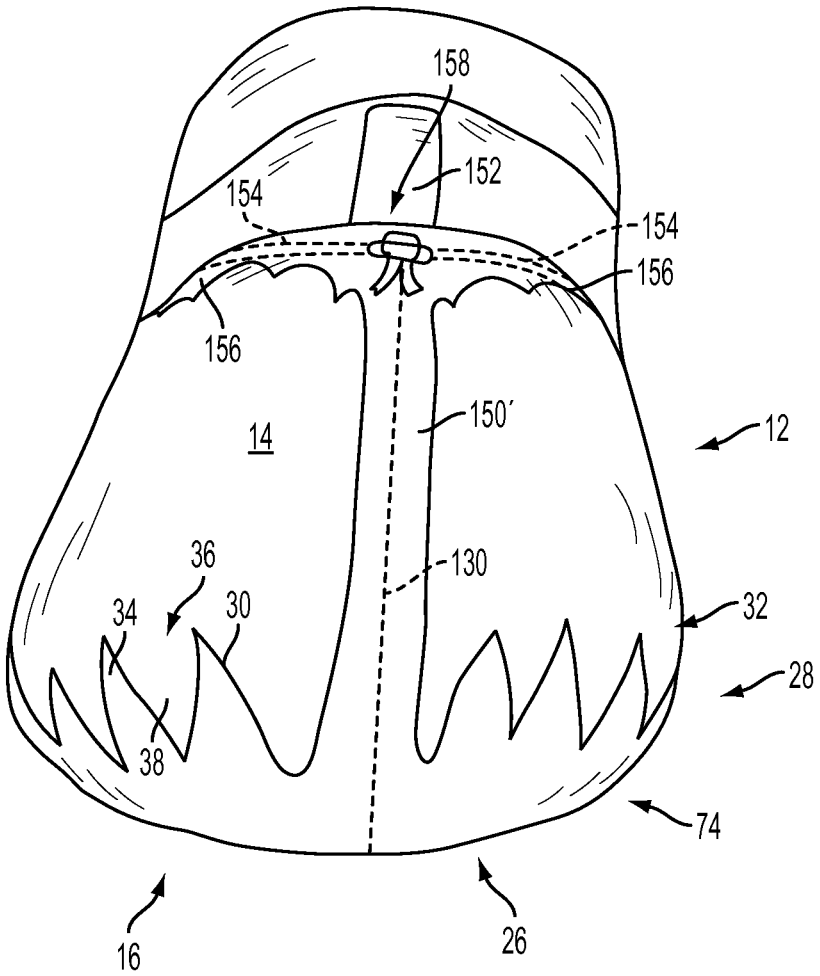
FIG. 5 is a rear elevation view of an alternative embodiment shoe cover showing a center finger and a seam shown in phantom positioned behind the center finger.

As shown in FIG. 3, fingers 32 include a front, center finger 148 that covers seam 130 (shown in phantom). As shown in FIG. 4, fingers 32 include a rear, center finger 150 that covers a portion (shown in phantom) of seam 130 and another portion (shown in solid) of seam 130 is uncovered. An alternative rear, center finger 150' is shown in FIG. 5 that covers all of seam 130 extending up heel portion 96. As a result, none of seam 130 is exposed. Cover 12 may also include loop 152 sewn or otherwise coupled to heel portion 96 to assist a user in pulling cover 12 over the heel of shoe 10.

As also shown in FIG. 5, cover 12 may include a cinch cord 154 positioned in cuff 156 that allows cuff 156 to be cinched around shoe 10. Cinch lock 158 is provided to lock cinch cord 154 in the desired position.

Figure 8:
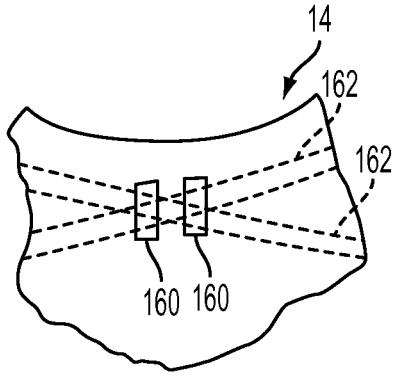
FIG. 8 is a top plan view of a portion of the shoe and shoe cover of FIG. 1A showing a pair of openings in the shoe cover that receive shoe laces of the shoe.

As shown in FIG. 8, top portion of covering 14 includes pair of openings 160 that receive shoe laces 162 therethrough. By placing shoe laces 162 through openings 160, shoe cover 12 is held up on shoe 10 in the desired location. Laces 162 can extend through openings 160 and back under covering 14 as shown in FIG. 8 or they can extend out openings 160 and remain outside of covering 14, where they are tied.

Many of the features and sub-features described herein function partially or totally independently of each other. Thus, many features and sub-features are optional depending on the needs of the particular circumstances. Additionally, features and sub-features described herein with reference to a particular embodiment may also be provided on the other embodiments described herein.

The invention claimed is:

1. A shoe cover sized to receive a shoe having an upper and a sole including:

a covering having a first stiffness and sized to receive a shoe, the covering being made of a form-fitting fabric; and a sole coupled to the covering and made of a different material than the covering and having a second stiffness that is greater than the first stiffness, the covering and the sole cooperating to define a transition area including a portion of the covering and a portion of the sole, the transition area being positioned at least partially on a lateral side of the shoe cover and at least partially on a bottom side of the shoe cover, the sole having at least one serrated edge positioned in the transition area to permit stretching of the covering in the transition area, the at least one serrated edge including a plurality of peaks and a plurality of valleys, a portion of the covering positioned in the valleys, and at least two of the plurality of peaks extending in a first direction having a rearward component relative to the shoe cover.

2. The shoe cover of claim 1, wherein at least two of the plurality of peaks extend in a second direction having a forward component that is opposite the rearward component, at least one of the plurality of peaks extending in the first direction being positioned adjacent to one of the plurality of peaks extending in the second direction.

3. The shoe cover of claim 1, wherein the shoe cover has a longitudinal length having a midpoint and a plurality of the peaks extend in a direction having a component extending in a direction away from the midpoint and a plurality of peaks extend in a direction having a component extending in a direction toward the midpoint.

4. The shoe cover of claim 1, wherein the shoe cover has a longitudinal length having a midpoint, at least a first of the plurality of peaks extends in a direction having a component extending in a direction away from the midpoint, at least a second of the plurality of the peaks extend in a direction having a component extending in a direction toward the midpoint, and the second peak is positioned between the midpoint and the first peak.

5. The shoe cover of claim 1, wherein the form-fitting fabric includes 90% nylon or polyester and 10% spandex or elastane and the sole is made of a fabric having substrate made of a woven polyester that is coated with PVC resin.

6. The shoe cover of claim 1, wherein the bottom side of the shoe cover is defined by a plurality of portions of the covering separated from each other by a plurality of portions of the sole.

7. The shoe cover of claim 1, wherein a portion of the covering extends from the edge of a first peak of the plurality of peaks to the edge of a second peak of the plurality of peaks, the second peak being positioned adjacent to the first peak.

8. The shoe cover of claim 1, wherein the sole has a uniform thickness.

9. The shoe cover of claim 1, wherein the cover has a uniform thickness.

10. A shoe cover sized to receive a shoe having an upper and a sole including:

a form-fitting covering sized to receive a shoe; and a sole coupled to the covering, the sole having a bottom portion normally positioned under a sole of a shoe received by the covering and a perimeter having a plurality of fingers having a portion of the form-fitting covering extending between the fingers, the covering including a forward portion and a rearward portion and at least two of the plurality of fingers are positioned adjacent to the forward portion, the cover including a bottom surface defined by the bottom portion of the sole and a plurality of portions of the covering separated by a portion of the plurality of fingers, wherein the covering includes a toe portion and a seam extending up the toe portion and at least one of the fingers covers the seam.

11. The shoe cover of claim 10, wherein the covering includes a heel portion and a seam extending up the heel portion and at least one of the fingers covers the seam of the heel portion.

12. The shoe cover of claim 10, wherein at least one of the fingers extends in a first direction having a forward component and at least of the fingers extends in a second direction having a rearward component.

13. The shoe cover of claim 10, wherein at least one of the fingers includes a portion facing downward and a portion facing outward.

14. The shoe cover of claim 10, wherein at least one of the plurality of fingers has a first portion extending in a first direction having a component oriented towards the rearward portion of the covering and a second portion between the first portion and the bottom of the sole not having a component oriented towards the rearward portion of the covering.

15. The shoe cover of claim 10, wherein the covering is made of a form-fitting fabric and the sole comprises a fabric including a substrate, the substrate being made of a woven polyester coated with PVC resin.

16. The shoe cover of claim 10, wherein the covering is positioned inward of the sole.

17. The shoe cover of claim 10, wherein the covering has a first portion positioned above a first portion of the sole and a second portion positioned below a second portion of the sole.

* * * * *